US007753342B1

(12) United States Patent
Nolle

(10) Patent No.: US 7,753,342 B1
(45) Date of Patent: Jul. 13, 2010

(54) PRY BAR

(76) Inventor: Jon S. Nolle, 56 Jezierski La., Thompson, CT (US) 06277

( * ) Notice: Subject to any disclaimer, the term of this patent is extended or adjusted under 35 U.S.C. 154(b) by 0 days.

(21) Appl. No.: 12/290,009

(22) Filed: Oct. 24, 2008

Related U.S. Application Data

(60) Provisional application No. 60/983,170, filed on Oct. 27, 2007, provisional application No. 61/190,240, filed on Aug. 27, 2008.

(51) Int. Cl.
*B66F 15/00* (2006.01)
*B25C 11/00* (2006.01)

(52) U.S. Cl. ..... 254/25; 227/63

(58) Field of Classification Search ..... 254/21, 254/25, 130, 131, 131.5, 27; 227/63; 56/400.01; 81/45, 46; *B66F 15/00; B25C 11/00*
See application file for complete search history.

(56) References Cited

U.S. PATENT DOCUMENTS 2,212,716 A * 8/1940 Noble et al. ..... 254/131
2,680,003 A * 6/1954 Feinstein ..... 254/131
3,014,749 A * 12/1961 Carrow ..... 294/26
5,177,941 A * 1/1993 Tharp et al. ..... 56/1
6,446,401 B1 * 9/2002 Krupp ..... 52/127.5
7,040,195 B1 * 5/2006 Lackey et al. ..... 81/45
7,311,293 B2 * 12/2007 Mrugalski, Jr. ..... 254/25

FOREIGN PATENT DOCUMENTS

GB 2252544 A * 8/1992
GB 2265852 A * 10/1993
JP 10156755 A * 6/1998
JP 11090858 A * 4/1999

* cited by examiner

*Primary Examiner*—Joseph J Hail, III
*Assistant Examiner*—Jamal Daniel
(74) *Attorney, Agent, or Firm*—Gerry A. Blodgett; Blodgett & Blodgett, P.C.

(57) ABSTRACT

A pry tool [10] comprising an hollow handle [11]; a first claw [16] having a first end [17], and a second end [18], the first end [17] being attached inside the lower end of the handle [11], and the second end [18] extending away from the lower end [13] of the handle [11]; a second claw [21] having a first end [22], and a second end [23], the first end [22] being attached inside the lower end [13] of the handle [11], and the second end [23] extending away from the lower end [13] of the handle [11]; and a rocker [26], having a first end [27] and a second end [28] attached to the lower end [13] of the handle [11], and a central portion [29] that curves around the lower end [13] of the handle [11] and between the claws [16] and [21] to form a rocker surface [30].

4 Claims, 9 Drawing Sheets

12
10
11
15
14
13
27
17
26
29
22
24
19
21
16
30
25
18
23
20

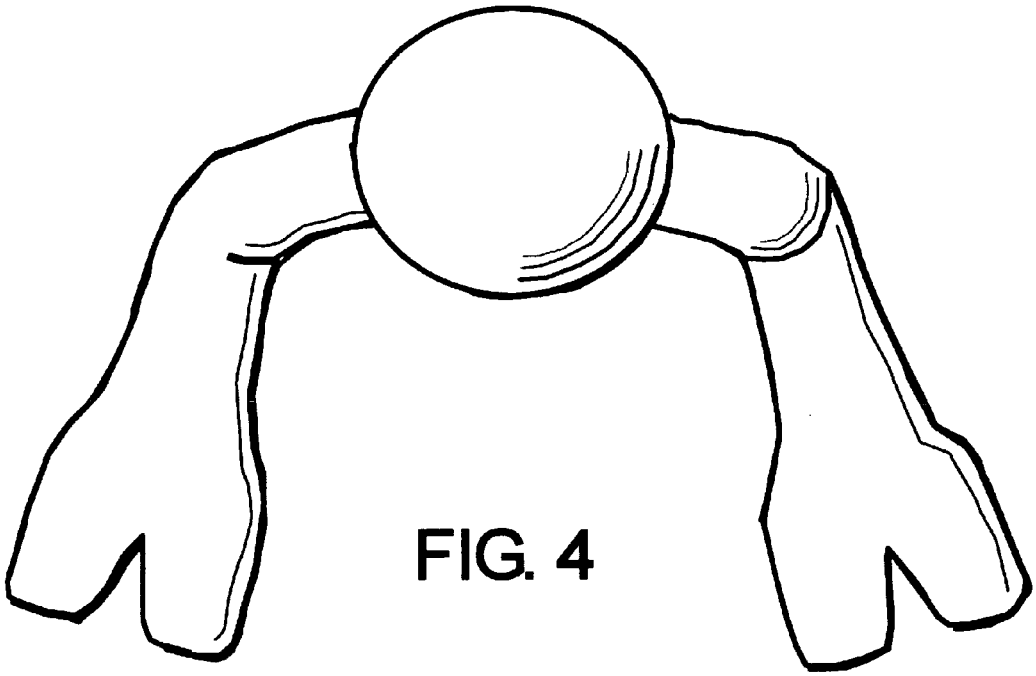
FIG. 4
FIG. 5
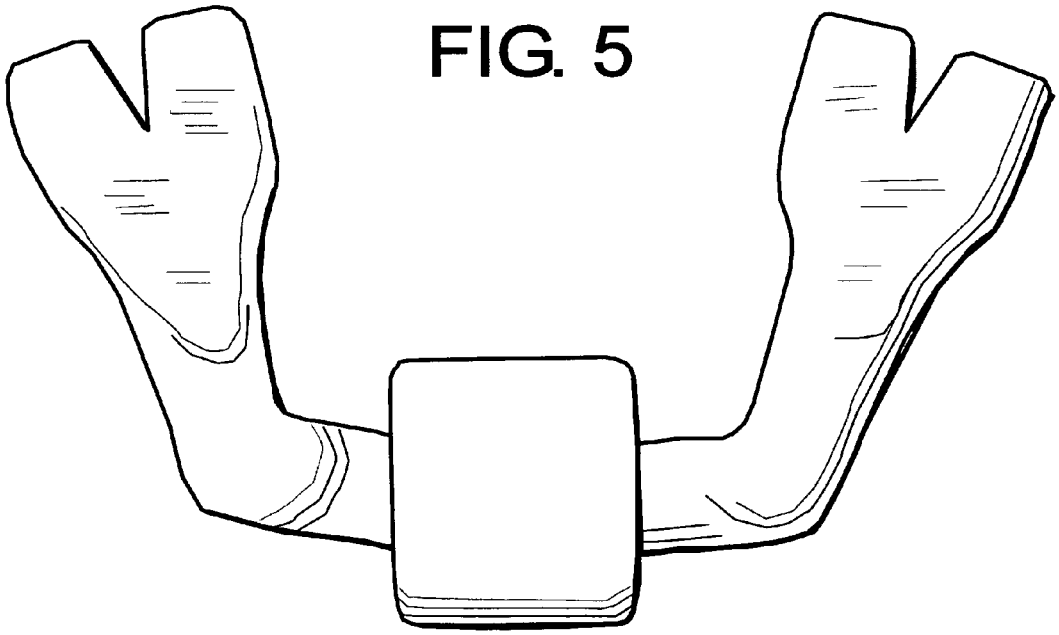

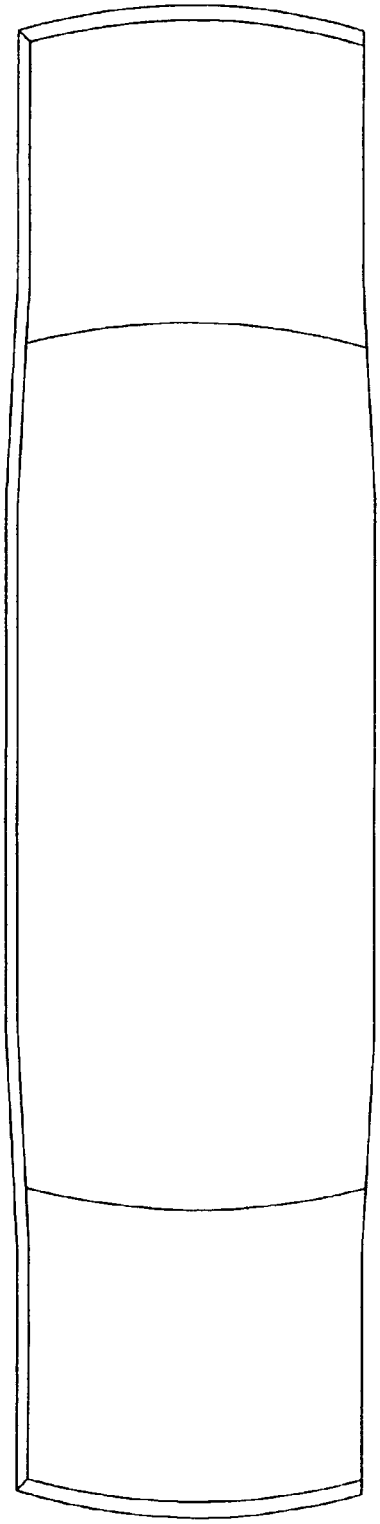
FIG. 9
FIG. 10
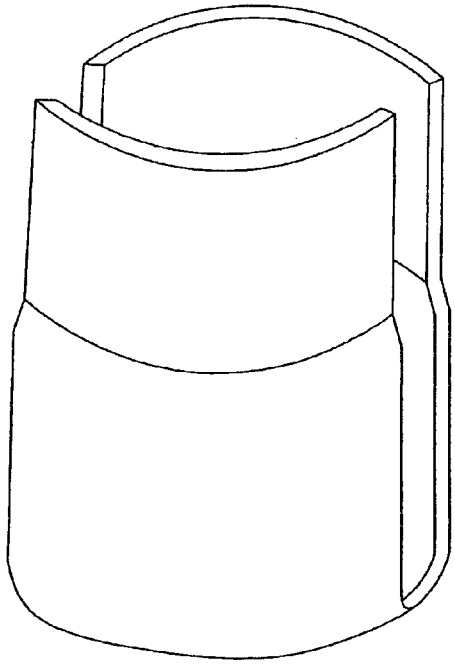

PRY BAR

CROSS-REFERENCE TO RELATED APPLICATIONS

This application claims the benefit under 35 U.S.C. section 119(e) of U.S. Provisional patent application No. 60/983,170 filed Oct. 27, 2007 and U.S. Provisional patent application No. 61/190,240 filed Aug. 27, 2008, all of which is hereby incorporated by reference.

STATEMENT REGARDING FEDERALLY SPONSORED RESEARCH OR DEVELOPMENT

This invention has been created without the sponsorship or funding of any federally sponsored research or development program.

REFERENCE TO SEQUENCE LISTING, A TABLE, OR A COMPUTER PROGRAM LISTING COMPACT DISK APPENDIX

Not applicable.

THE FIELD OF THE INVENTION

This invention involves a pry bar for demolition, and especially for removing floorboards from joists, and especially deck boards.

BACKGROUND OF THE INVENTION

It is frequently necessary, in building demolition and/or remodeling, to remove floor boards from floor joists, and wall boards from wall studs. The tools that are used for this activity are awkward, too heavy, ineffective, insufficiently durable, or too complex to be manufactured efficiently and economically.

These and other difficulties experienced with the prior art devices have been obviated in a novel manner by the present invention.

It is, therefore, an outstanding object of some embodiments of the present invention to provide a pry tool that efficiently and effectively removes boards from joists or studs.

It is a further object of some embodiments of the invention to provide a pry tool that efficiently and effectively removes the first board in a floor or wall boards from joists or studs.

It is a still further object of some embodiments of the invention to provide a pry tool that is simple and easy to use, relatively light in weight, effective in use, durable, or capable of being manufactured efficiently and economically.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention involves a pry tool, designated generally by the number 10, includes an elongated handle 11 having an axis, an upper end 12 and a lower end 13, and a first side 14 and a second side 15. It also includes a first claw 16 having a first end 17, a second end 18, and a central portion 19, the first end 17 being attached to the lower end 13 of the handle 11, the central portion 19 extending outward from the axis and beyond the first side 14 of the handle 11, and the second end 18 extending away from the lower end 13 of the handle 11, and including a v-groove 20. It also includes a second claw 21 having a first end 22, a second end 23, and a central portion 24, the first end 22 being attached to the lower end 13 of the handle 11, the central portion 24 extending outward from the axis of the handle 11, and beyond the second side 15 of the handle 11, and the second end 23 extending away from the lower end 13 of the handle 11, and including a v-groove 25; and it also includes a rocker 26, having a first end 27 attached to the lower end 13 of the handle 11, second end 28 attached to the lower end 13 of the handle 11, and a central portion 29 that curves around the lower end 13 of the handle 11 and between the first and second claws 16 and 21 to form a rocker surface 30 between the first and second claws 16 and 21.

The invention also includes a method for removing a board that is attached to a joint from the joist, comprising the steps of positioning a pry tool comprising, an elongated handle 11 having an axis, an upper end 12 and a lower end 13, and a first side 14 and a second side 15; a first claw 16 having a first end 17, a second end 18, and a central portion 19, the first end 17 being attached to the lower end 13 of the handle 11, the central portion 19 extending outward from the axis and beyond the first side 14 of the handle 11, and the second end 18 extending away from the lower end 13 of the handle 11, and including a v-groove 20; a second claw 21 having a first end 22, a second end 23, and a central portion 24, the first end 22 being attached to the lower end 13 of the handle 11, the central portion 24 extending outward from the axis of the handle 11, and beyond the second side 15 of the handle 11, and the second end 23 extending away from the lower end 13 of the handle 11, and including a v-groove 25; and a rocker 26, having a first end 27 attached to the lower end 13 of the handle 11, second end 28 attached to the lower end 13 of the handle 11, and a central portion 29 that curves around the lower end 13 of the handle 11 and between the first and second claws 16 and 21 to form a rocker surface 30 between the first and second claws 16 and 21; with the claws on different sides of the joist and below the board and in contact with the lower surface of the board, with the rocker on the joist, and moving the handle away from the board and toward the joist, to cause the claws to push the board away from the joist.

BRIEF DESCRIPTION OF THE SEVERAL VIEWS OF THE DRAWING

The character of the invention, however, may best be understood by reference to one of its structural forms, as illustrated by the accompanying drawings, in which:

FIG. 4 is a top view of the embodiment shown in FIG. 1;

FIG. 5 is a bottom view of the embodiment shown in FIG. 1;

FIG. 9 is a perspective view of the rocker element, prior to being bent, of the embodiment shown in FIG. 1;

FIG. 10 is a perspective view of the rocker element shown in FIG. 9, after being bent, of the embodiment shown in FIG. 1;

DETAILED DESCRIPTION OF THE INVENTION

Figures 1, 2, 3:
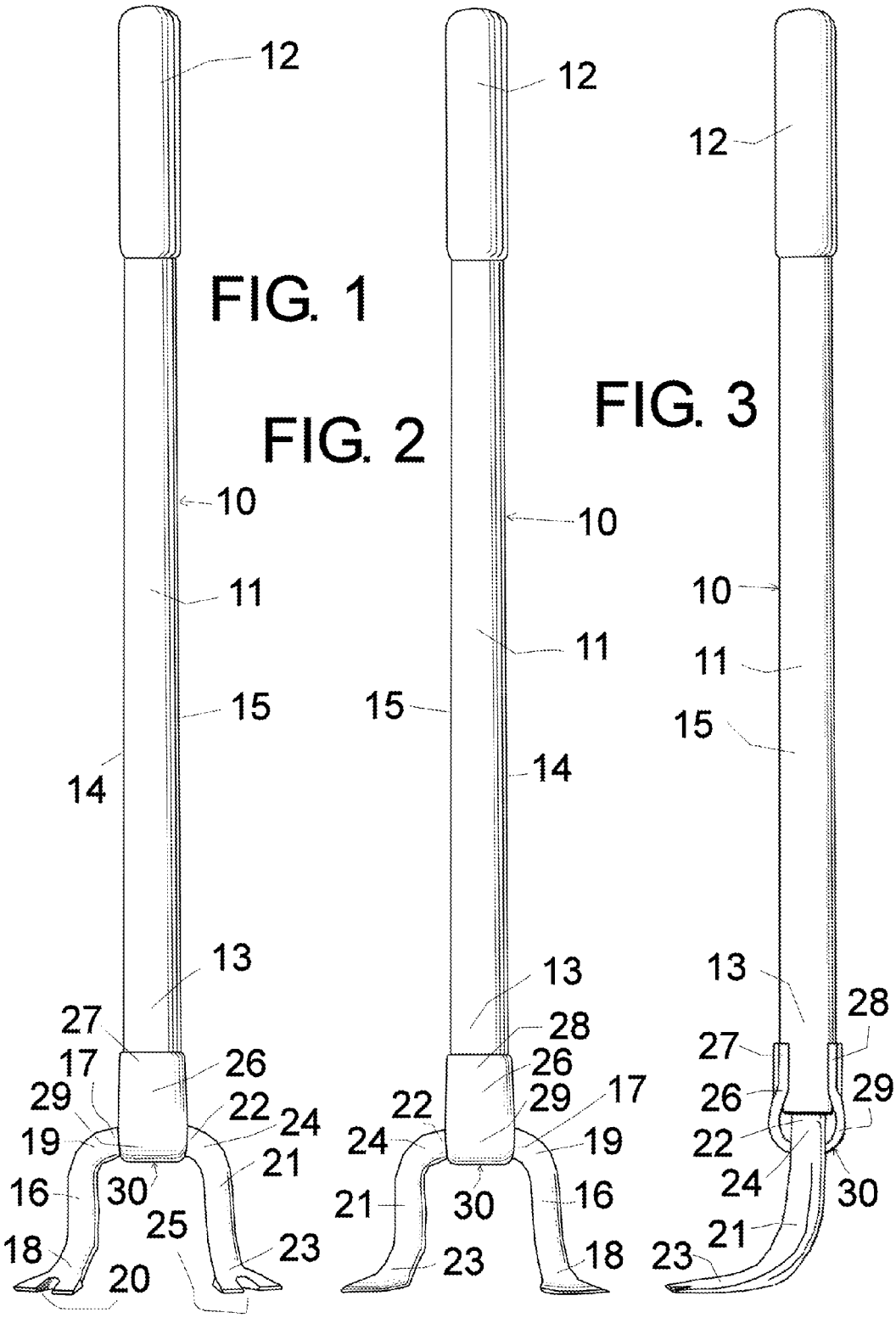
FIG. 1 is a front elevation view of one of the present invention.
FIG. 2 is a rear elevation view of the embodiment shown in FIG. 1.
FIG. 3 is a right side elevation view of the embodiment shown in FIG. 1.

Referring first to FIG. 1, wherein are best shown the general features of one embodiment of the invention, the pry tool, designated generally by the number 10, includes an elongated handle 11 having an axis, an upper end 12 and a lower end 13, and a first side 14 and a second side 15. It also includes a first claw 16 having a first end 17, a second end 18, and a central portion 19, the first end 17 being attached to the lower end 13 of the handle 11, the central portion 19 extending outward from the axis and beyond the first side 14 of the handle 11, and the second end 18 extending away from the lower end 13 of the handle 11, and including a v-groove 20. It also includes a second claw 21 having a first end 22, a second end 23, and a central portion 24, the first end 22 being attached to the lower end 13 of the handle 11, the central portion 24 extending outward from the axis of the handle 11, and beyond the second side 15 of the handle 11, and the second end 23 extending away from the lower end 13 of the handle 11, and including a v-groove 25; and it also includes a rocker 26, having a first end 27 attached to the lower end 13 of the handle 11, second end 28 attached to the lower end 13 of the handle 11, and a central portion 29 that curves around the lower end 13 of the handle 11 and between the first and second claws 16 and 21 to form a rocker surface 30 between the first and second claws 16 and 21.

The invention also includes a method for removing a board that is attached to a joint from the joist, comprising the steps of positioning a pry tool comprising, an elongated handle 11 having an axis, an upper end 12 and a lower end 13, and a first side 14 and a second side 15; a first claw 16 having a first end 17, a second end 18, and a central portion 19, the first end 17 being attached to the lower end 13 of the handle 11, the central portion 19 extending outward from the axis and beyond the first side 14 of the handle 11, and the second end 18 extending away from the lower end 13 of the handle 11, and including a v-groove 20; a second claw 21 having a first end 22, a second end 23, and a central portion 24, the first end 22 being attached to the lower end 13 of the handle 11, the central portion 24 extending outward from the axis of the handle 11, and beyond the second side 15 of the handle 11, and the second end 23 extending away from the lower end 13 of the handle 11, and including a v-groove 25; and a rocker 26, having a first end 27 attached to the lower end 13 of the handle 11, second end 28 attached to the lower end 13 of the handle 11, and a central portion 29 that curves around the lower end 13 of the handle 11 and between the first and second claws 16 and 21 to form a rocker surface 30 between the first and second claws 16 and 21; with the claws on different sides of the joist and below the board and in contact with the lower surface of the board, with the rocker on the joist, and moving the handle away from the board and toward the joist, to cause the claws to push the board away from the joist.

FIG. 1 is a front elevation view of one of the present invention.

FIG. 2 is a rear elevation view of the embodiment shown in FIG. 1.

FIG. 3 is a right side elevation view of the embodiment shown in FIG. 1.

FIG. 4 is a top view of the embodiment shown in FIG. 1.

FIG. 5 is a bottom view of the embodiment shown in FIG. 1.

Figure 6:
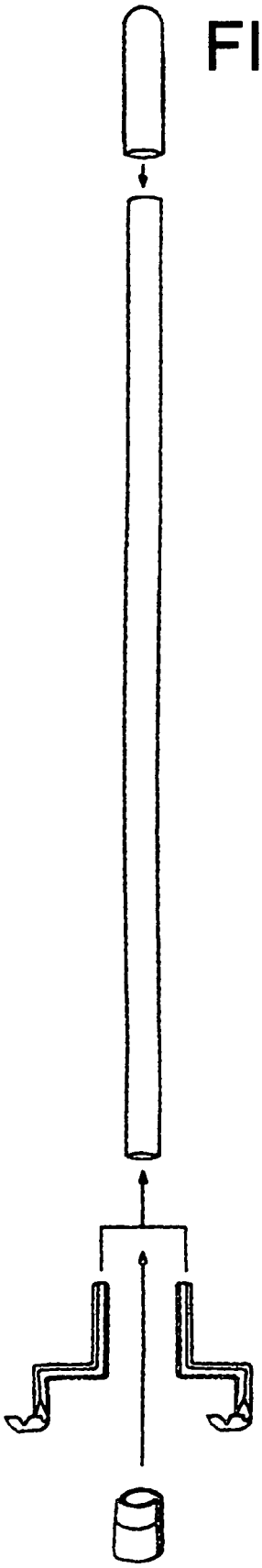
FIG. 6 is an exploded perspective view that shows the physical relationship between the various parts of the embodiment shown in FIG. 1.

FIG. 6 is an exploded perspective view that shows the physical relationship between the various parts of the embodiment shown in FIG. 1.

Figure 7:
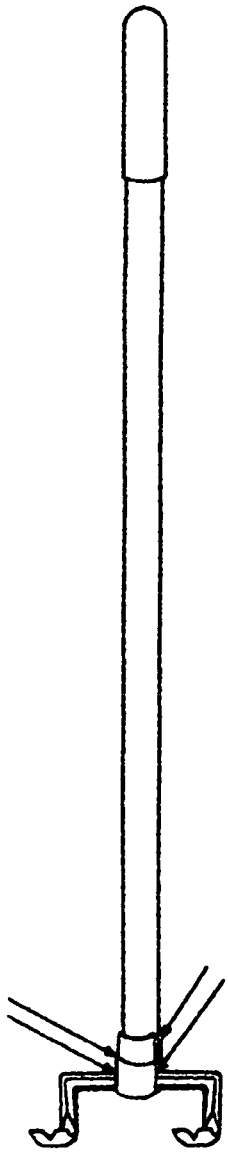
FIG. 7 is a perspective view embodiment shown in FIG. 1, indicating preferred weld locations.

FIG. 7 is a perspective view embodiment shown in FIG. 1, indicating preferred weld locations.

Figure 8:
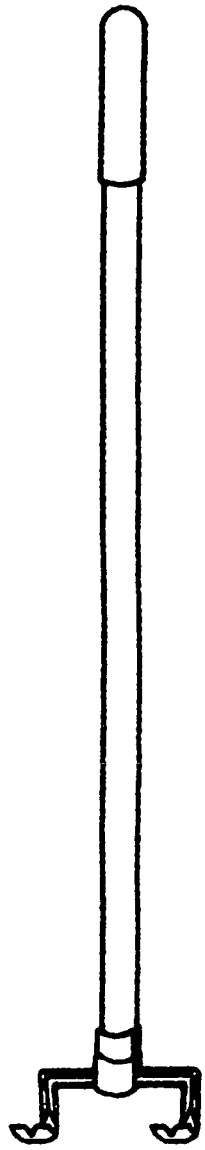
FIG. 8 is a perspective view of the embodiment shown in FIG. 1.

FIG. 8 is a perspective view of the embodiment shown in FIG. 1.

FIG. 9 is a perspective view of the rocker element, prior to being bent, of the embodiment shown in FIG. 1.

FIG. 10 is a perspective view of the rocker element shown in FIG. 9, after being bent, of the embodiment shown in FIG. 1.

Figure 11:
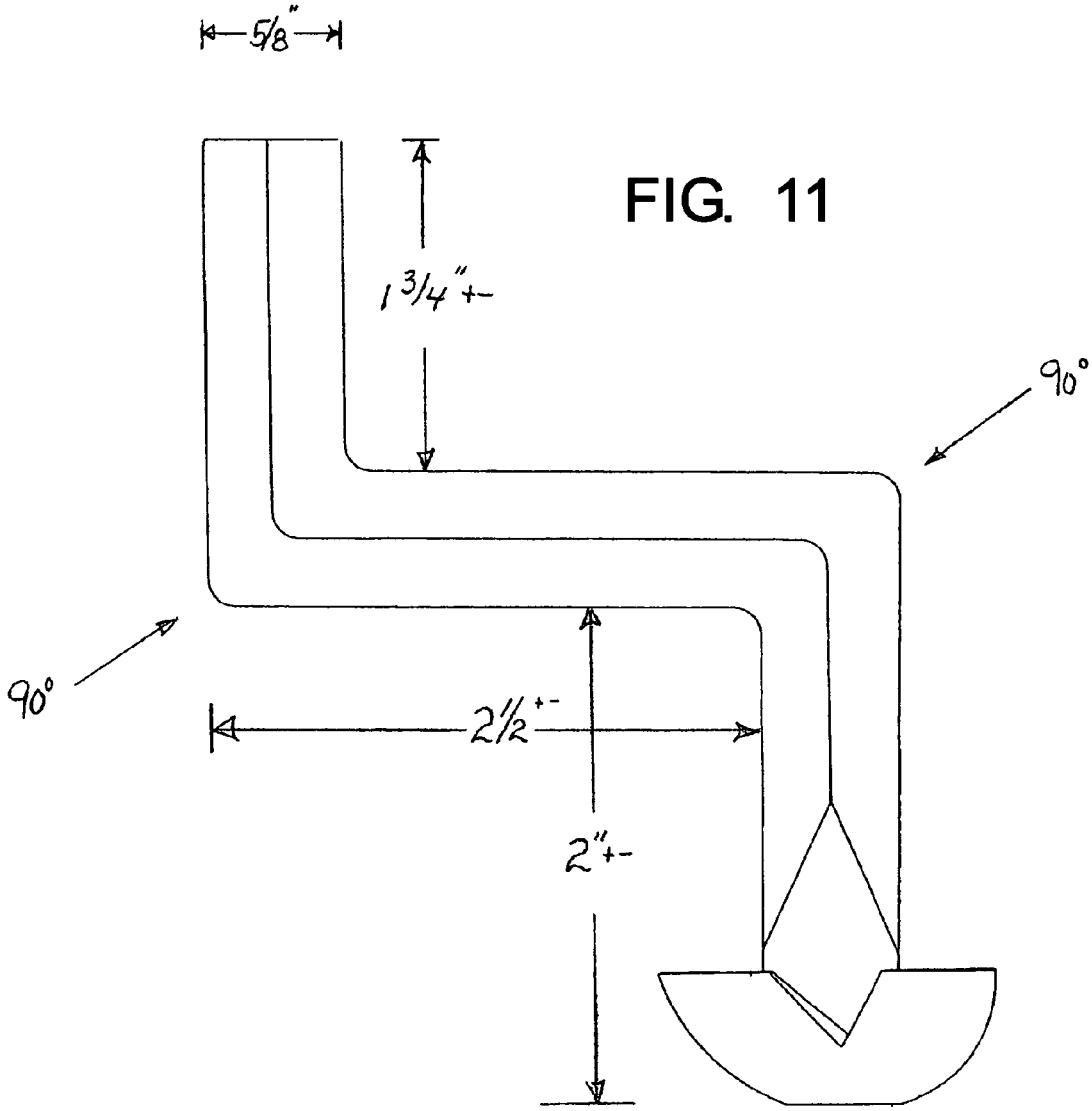
FIG. 11 is a front elevation view of the right side claw used in the embodiment shown in FIG. 1, and presenting some preferred dimensions of the claw, the left side claw would be the mirror image of the right side claw.

FIG. 11 is a front elevation view of the right side claw used in the embodiment shown in FIG. 1, and presenting some preferred dimensions of the claw, the left side claw would be the mirror image of the right side claw.

Figure 12:
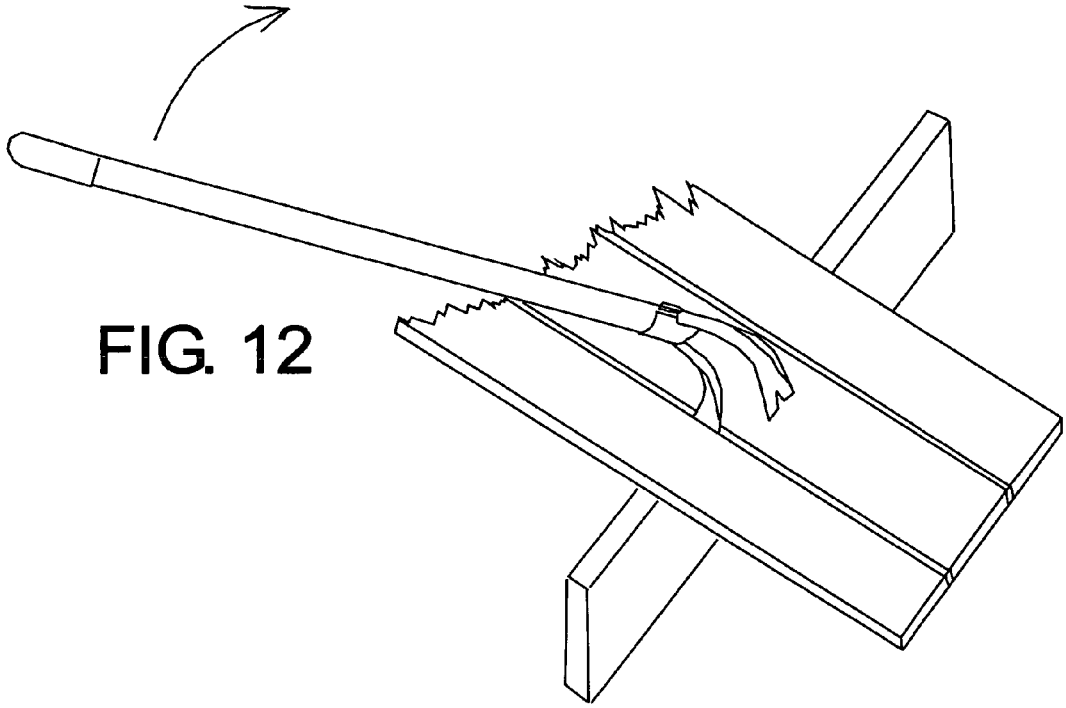
FIG. 12 is a perspective view of the embodiment shown in FIG. 1, in which one claw is being used to lift a floorboard when the adjacent floorboard has not yet been removed.

FIG. 12 is a perspective view of the embodiment shown in FIG. 1, in which one claw is being used to lift a floorboard when the adjacent floorboard has not yet been removed.

Figure 13:
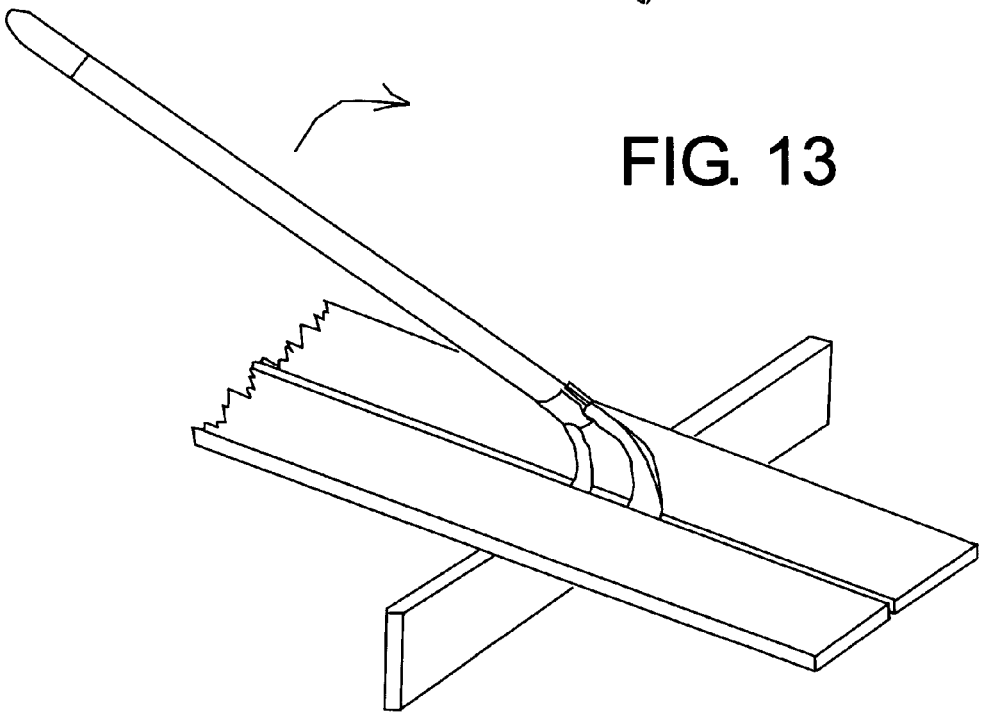
FIG. 13 is a perspective view of the embodiment shown in FIG. 1, in which both of the claws are being used to lift a floorboard when the adjacent floorboard has not yet been removed.

FIG. 13 is a perspective view of the embodiment shown in FIG. 1, in which both of the claws are being used to lift a floorboard when the adjacent floorboard has not yet been removed.

Figure 14:
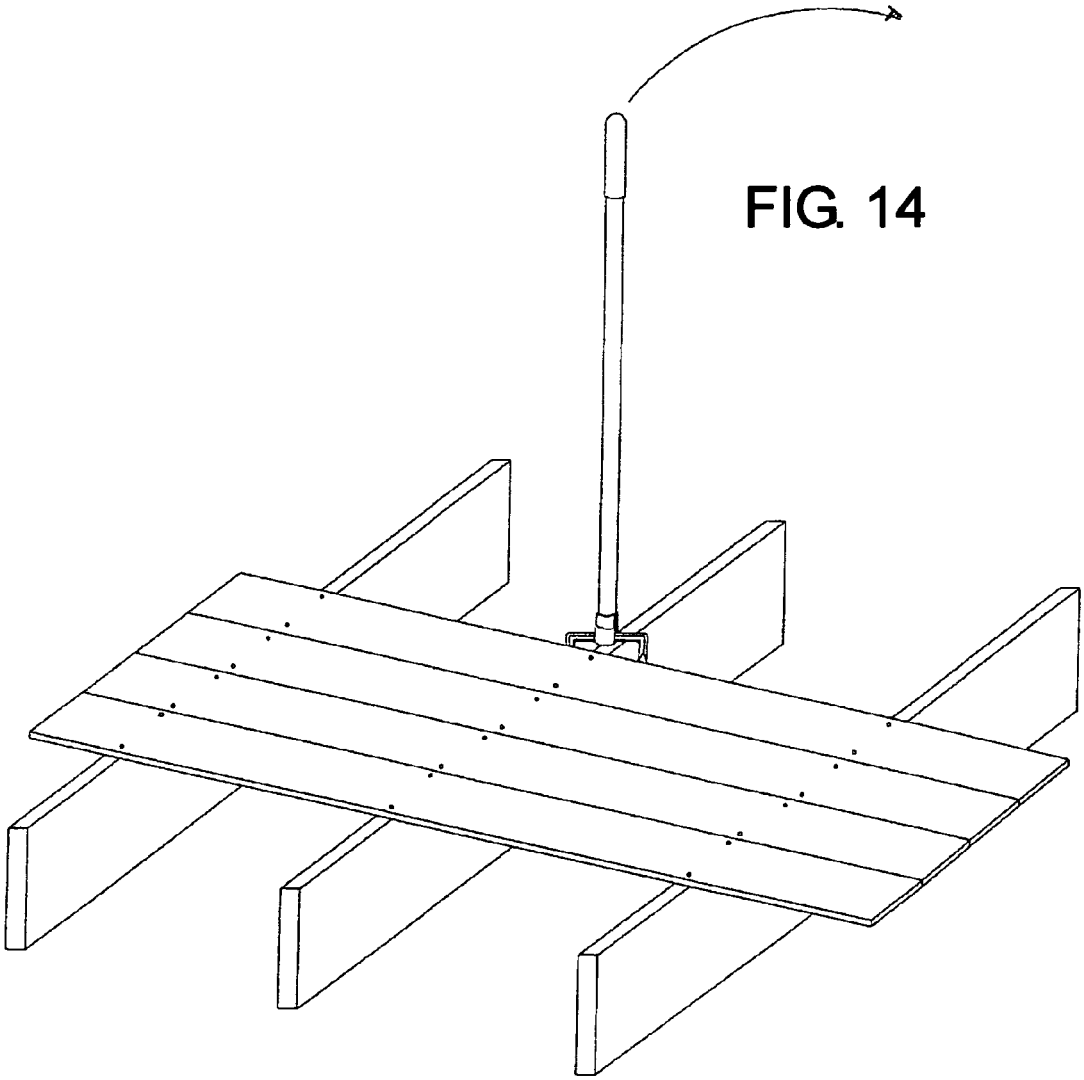
FIG. 14 is a perspective view, from above the floor, of the embodiment shown in FIG. 1 being used to remove a floorboard from a joist.

FIG. 14 is a perspective view, from above the floor, of the embodiment shown in FIG. 1 being used to remove a floorboard from a joist.

Figure 15:
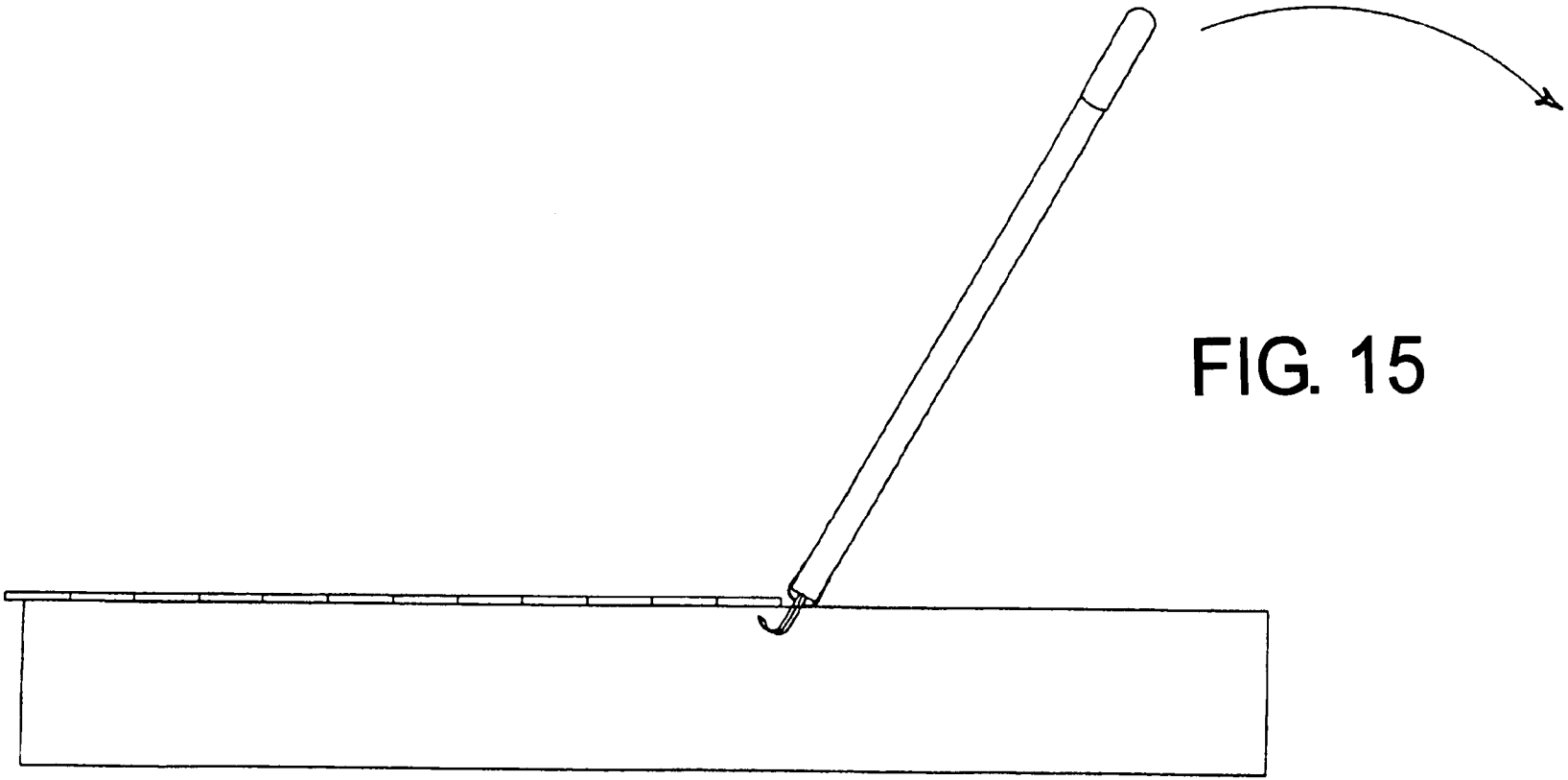
FIG. 15 is a side view, from below the floor, of the embodiment of the embodiment shown in FIG. 1 being used to remove a floorboard from a joist.

FIG. 15 is a side view, from below the floor, of the embodiment of the embodiment shown in FIG. 1 being used to remove a floorboard from a joist.

Figure 16:
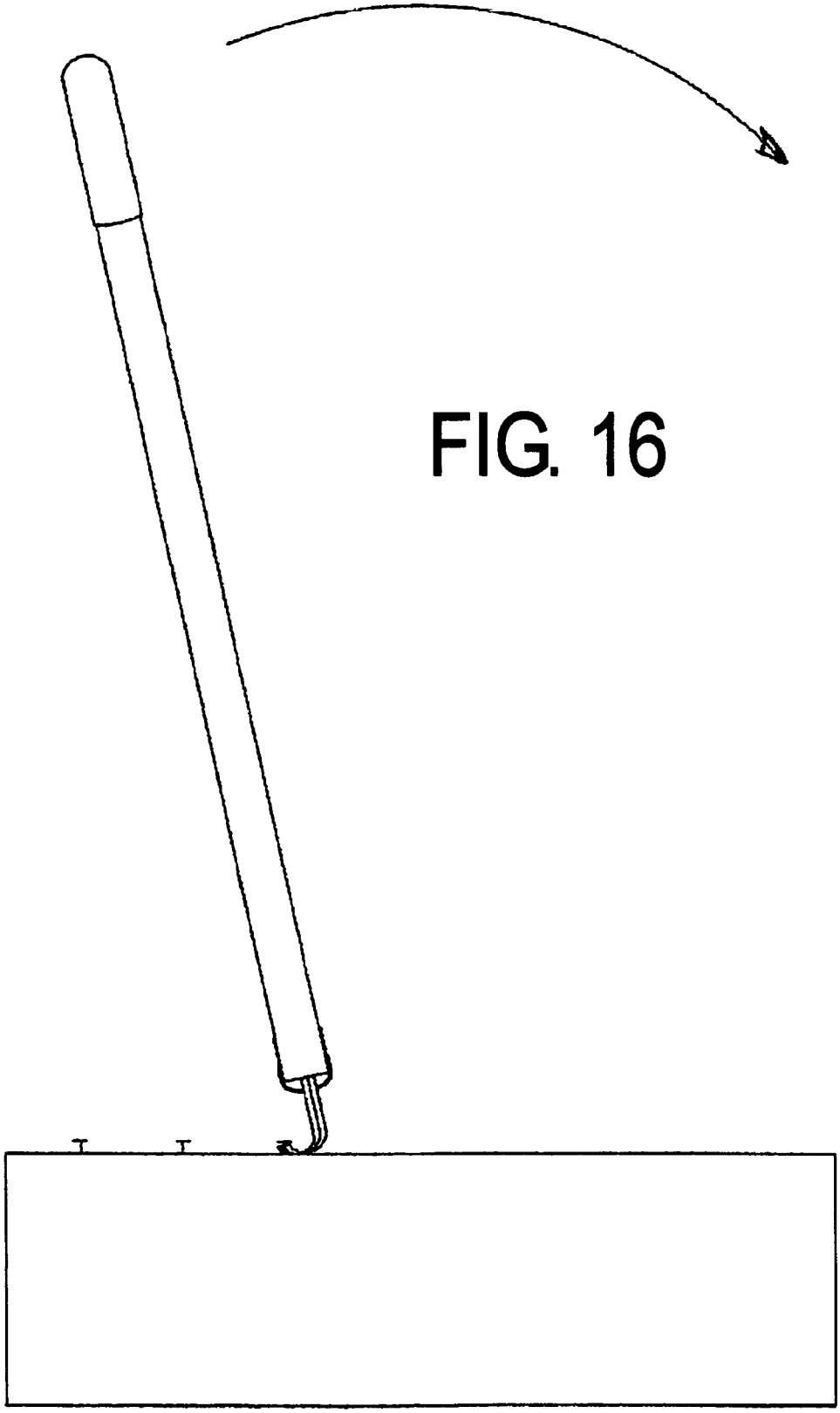
FIG. 16 is a side view of the embodiment shown in FIG. 1 being used to remove a fastener from a joist.

FIG. 16 is a side view of the embodiment shown in FIG. 1 being used to remove a fastener from a joist.

This invention is a pry tool that is a multipurpose wrecking bar designed to remove all types and sizes of deck floor boards such as ¾ inch to 2 inch pressure treated—composite—hardwood and others. However, it is not limited only to the removal of deck floor boards. For example, it can also be used to remove hardwood flooring with ease.

This tool is designed to be multi purpose. It can start the initial removal of the first deck floor board by using one or both of the 90 degree claw ends as shown in FIGS. 12 and 13.

After the first board is removed, the tool can easily remove the next deck board without damaging the floor joist as shown in FIGS. 14 and 15. In some embodiments, it can also be used on double joists, because the claws are spread sufficiently to strattle the double joist and the rocker is wide enough. The bar has enough depth at the claw end to extend approximately 3½ inches under the deck floor board to add additional leverage for removal.

The bar can easily remove all types of fasteners such as nails and screws that are commonly used to attach the floor boards to the floor joists, that may not come up with the floor board as seen in FIG. 16. It can also be used to remove fasteners against walls (right or left handed applications).

In one embodiment, the pry bar is made from schedule 40 steel approximately 46 inches in height and weighs approximately 8 pounds. It is powder coated and has a 1.219×6 inch foam grip handle.

Both claws have 90 degree ends with a V-groove to remove the fasteners and/or to start the removal procedure. There are no moving or replacement parts required. The bar also has 3/16 inch×1.5 inch×6 inch flat stock bent into a rocker and attached to the end, to eliminate damage to the floor joist.

All required parts to build the tool are welded together.

This tool eliminates the need for a single sleeve starter bar, nail removal bar, and will not damage joists.

In the preferred embodiment or second design, the crow bar ends are spread apart enough to that the will fit over a double joist with ease as well as achieve the same results as the first design. Also, the rocker is wide enough to contact both joists.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims. It is obvious that minor changes may be made in the form and construction of the invention without departing from the material spirit thereof. It is not, however, desired to confine the invention to the exact form herein shown and described, but it is desired to include all such as properly come within the scope claimed.

What I claim as my invention is:

1. A pry tool (10) comprising:

a) an elongated handle (11) having an a longitudinal axis, an upper end (12) and a lower end (13), and a first side (14) and a second side (15);

b) a first claw (16) having a first end (17), a second end (18), and a central portion (19), the first end (17) being attached to the lower end (13) of the handle (11), the central portion (19) having a first diameter and extending outward from the axis and beyond the first side (14) of the handle (11), and the second end (18) extending away from the lower end (13) of the handle (11);

c) a second claw (21) having a first end (22), a second end (23), and a central portion (24), the first end (22) being attached to the lower end (13) of the handle (11), the central portion (24) having a second diameter and extending outward from the axis of the handle (11), and beyond the second side (15) of the handle (11), and the second end (23) extending away from the lower end (13) of the handle (11); and d) a rocker (26), having a first end (27) attached to the lower end (13) of the handle (11), second end (28) attached to the lower end (13) of the handle (11), and a central portion (29) that curves around the lower end (13) of the handle (11) and between the first and second claws (16) and (21) to form an outward-facing rocker surface (30) between the first and second claws (16) and (21), and having a third diameter, wherein the third diameter is greater than the first and second diameters, wherein the handle (11) is a hollow tube, and the first end (17) of the first claw (16), and the first end (22) of the second claw (21) are inside the handle (11), and wherein the first end (17) of the first claw (16), and the first end (22) of the second claw (21) are elongated and extend a substantial distance inside the handle (11) and along its longitudinal axis, and parallel to each other, and the first end (17) of the first claw (16), and the first end (22) of the second claw (21) are welded to the handle.

2. A pry tool (10), as recited in claim 1, wherein the second end of at least one of the claws includes a v-groove.

3. A method for removing a board that is attached to a joint from the joist, comprising the steps of:

a) positioning a pry tool (10) comprising:

i) an elongated handle (11) having an a longitudinal axis, an upper end (12) and a lower end (13), and a first side (14) and a second side (15);

ii) a first claw (16) having a first end (17), a second end (18), and a central portion (19), the first end (17) being attached to the lower end (13) of the handle (11), the central portion (19) having a first diameter and extending outward from the axis and beyond the first side (14) of the handle (11), and the second end (18) extending away from the lower end (13) of the handle (11);

iii) a second claw (21) having a first end (22), a second end (23), and a central portion (24), the first end (22) being attached to the lower end (13) of the handle (11), the central portion (24) extending outward from the axis of the handle (11), and beyond the second side (15) of the handle (11), and the second end (23) extending away from the lower end (13) of the handle (11); and iv) a rocker (26), having a first end (27) attached to the lower end (13) of the handle (11), second end (28) attached to the lower end (13) of the handle (11), and a central portion (29) that curves around the lower end (13) of the handle (11) and between the first and second claws (16) and (21) to form an outwardly-facing rocker surface (30) between the first and second claws (16) and (21), having a third diameter and, wherein the third diameter is greater than the first and second diameters, wherein the handle (11) is a hollow tube, and the first end (17) of the first claw (16), and the first end (22) of the second claw (21) are inside the handle (11), and wherein the first end (17) of the first claw (16), and the first end (22) of the second claw (21) are elongated and extend a substantial distance inside the handle (11) and along its longitudinal axis, and parallel to each other, and the first end (17) of the first claw (16), and the first end (22) of the second claw (21) are welded to the handle;

v) with the second ends (18) and (23) of the claws (16) and (21) on different sides of the joist and below the board and in contact with the lower surface of the board, with the rocker (26) on the joist, and b) moving the handle (11) away from the board and toward the joist, to cause the claws (16) and (21) to push the board away from the joist.

4. A method as recited in claim 3, wherein the second end of at least one of the claws includes a v-groove.

* * * * *